US009334828B2

(12) United States Patent
Beyer et al.

(10) Patent No.: US 9,334,828 B2
(45) Date of Patent: May 10, 2016

(54) BORE BRIDGE AND CYLINDER COOLING

(71) Applicant: Ford Global Technologies, LLC, Dearborn, MI (US)

(72) Inventors: Theodore Beyer, Canton, MI (US); Jody Michael Slike, Farmington Hills, MI (US); Charles Joseph Patanis, South Lyon, MI (US); William Michael Sanderson, Milan, MI (US); Mathew Leonard Hintzen, Stockbridge, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 18 days.

(21) Appl. No.: 14/311,756

(22) Filed: Jun. 23, 2014

(65) Prior Publication Data

US 2015/0369167 A1 Dec. 24, 2015

(51) Int. Cl.
*F02F 1/16* (2006.01)

(52) U.S. Cl.
CPC ..... *F02F 1/16* (2013.01)

(58) Field of Classification Search
CPC . F01P 3/02; F01P 2003/024; F01P 2003/021; F01P 3/00; F01P 1/02; F02F 1/40; F02F 1/14; F02F 1/243; F02F 1/24; F02F 2001/104
USPC ..... 123/41.74, 41.01, 41.72, 41.67, 41.82 R, 123/193.3, 193.5; 277/313, 591–596
See application file for complete search history.

(56) References Cited

U.S. PATENT DOCUMENTS 4,377,990 A * 3/1983 Seidl ..... F01P 3/02 123/41.74
6,776,127 B2 * 8/2004 Osman ..... F02F 1/14 123/41.72
7,278,381 B2 * 10/2007 Matsutani ..... F01P 3/02 123/41.74
7,694,656 B2 * 4/2010 Thomas ..... F01L 7/02 123/190.4
8,171,897 B2 * 5/2012 Sugiura ..... F01P 1/02 123/41.01
8,256,389 B2 * 9/2012 Nomura ..... F02F 1/10 123/41.72
8,261,702 B2 * 9/2012 Fedeson ..... F01P 3/02 123/41.82 R
2011/0023799 A1 * 2/2011 Lenz ..... F01P 3/02 123/41.79
2012/0132155 A1 * 5/2012 Smith ..... F02F 1/40 123/41.79
2012/0240883 A1 9/2012 McGiffin et al.
2013/0284128 A1 * 10/2013 Beyer ..... F02F 1/16 123/41.82 R

FOREIGN PATENT DOCUMENTS

JP 2002168147 A * 6/2002 ..... F02F 1/10
JP 2007291916 A * 11/2007 ..... F02F 1/10

OTHER PUBLICATIONS

Machine translation of JP2002168147A, see "JP2002168147_ MachineTranslation.pdf", Nov. 8, 2007.*

* cited by examiner

*Primary Examiner* — Lindsay Low
*Assistant Examiner* — Long T Tran
(74) *Attorney, Agent, or Firm* — Brooks Kushman P.C.; Greg P. Brown

(57) ABSTRACT

An engine has a cylinder head with a deck face defining first and second chambers adjacent to one another and separated by a bore bridge. The body defines a first cooling jacket and a second cooling jacket configured to operate at a lower pressure than the first cooling jacket. The first cooling jacket is positioned substantially between the deck face and the second cooling jacket. The first cooling jacket has a series of passages intersecting the deck face and configured to receive coolant from a cylinder block cooling jacket. The second cooling jacket has an inlet passage intersecting the deck face adjacent to the bore bridge and configured to receive coolant from the cylinder block cooling jacket to cool the bore bridge.

17 Claims, 5 Drawing Sheets

BORE BRIDGE AND CYLINDER COOLING

TECHNICAL FIELD

Various embodiments relate to cooling passages for a bore bridge between two cylinders in an internal combustion engine.

BACKGROUND

During engine operation, the cylinder head and block need to be cooled, and a water jacket system with a water-cooled engine cylinder head design may be provided. The bore bridge on the cylinder block and/or the cylinder head is a stressed area with little packaging space. The bore bridge region heats during engine operation based on the position of the bridge between neighboring cylinders and the small dimensions of the bridge.

SUMMARY

In an embodiment, an internal combustion engine is provided with a cylinder block having a deck face defining first and second cylinders adjacent to one another, and a block cooling jacket. A cylinder head has a deck face defining first and second chambers adjacent to one another. The cylinder head defines a first head cooling jacket and a second head cooling jacket configured to operate at a lower pressure than the first head cooling jacket. The first chamber and the first cylinder form a first combustion chamber, and the second chamber and the second cylinder form a second combustion chamber, with the first and second combustion chambers separated by a bore bridge. The block cooling jacket has an outlet passage intersecting the block deck face on a first side of the bore bridge. The second head cooling jacket has an inlet passage intersecting the head deck face on a second side of the bore bridge. Coolant flows from the outlet passage along at least one of the block deck face and head deck face and to the inlet passage to cool the bore bridge.

In another embodiment, a cylinder head for an engine is provided with a body defining a deck face with first and second chambers adjacent to one another and separated by a bore bridge. The body defines a first cooling jacket and a second cooling jacket configured to operate at a lower pressure than the first cooling jacket. The first cooling jacket is positioned substantially between the deck face and the second cooling jacket. The first cooling jacket has a series of passages intersecting the deck face and configured to receive coolant from a cylinder block cooling jacket. The second cooling jacket has an inlet passage intersecting the deck face adjacent to the bore bridge and configured to receive coolant from the cylinder block cooling jacket to cool the bore bridge.

In yet another embodiment, an engine is provided with a cylinder head defining a first cooling jacket with a first passage intersecting a deck face and a second cooling jacket with a second passage intersecting the deck face adjacent to a bore bridge for cooling thereof. The first and second passages are configured to independently receive coolant from a cylinder block cooling jacket. The first jacket is adapted to provide coolant to the second jacket.

Various embodiments of the present disclosure have associated, non-limiting advantages. For example, in small packaged, high performance engines, the bore bridge, or region between adjacent cylinders may reach high temperatures during engine operation such that cooling the bore bridge is desirable. Because the engine packaging is small, there are few heat transfer paths for this region to be cooled. High temperatures at the bore bridge may lead to the cylinder block deforming, and the like. Also, at high temperatures, the head gasket may also deform or become overheated and lead to a reduced sealing capability for the combustion cylinders. The bore bridge may be cooled using coolant flowing through sawcuts in the bore bridges. The bore bridge cooling may be increased by providing coolant at high velocity in the bore bridge region, leading to increased convective heat transfer. The coolant velocity is increased by an increase in the pressure difference across this region, as coolant at high pressure will flow to a low pressure region. The pressure difference may be increased by increasing pressure on the feed side or lowering pressure on the exit side of the bore bridge region. The cylinder head of the engine has an upper cooling jacket and a lower cooling jacket, where the upper cooling jacket pressure is lower because there are few direct feeds of coolant to the upper jacket. By using the upper cooling jacket, a very low exit pressure may be provided, and a larger cooling pressure difference across the bore bridge region may be achieved, thereby providing a higher coolant velocity and greater heat transfer. Connecting to the upper head jacket from the block jacket may be challenging based on the geometry of the jackets, and the tight tolerances and engine packaging.

DETAILED DESCRIPTION

As required, detailed embodiments of the present disclosure are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
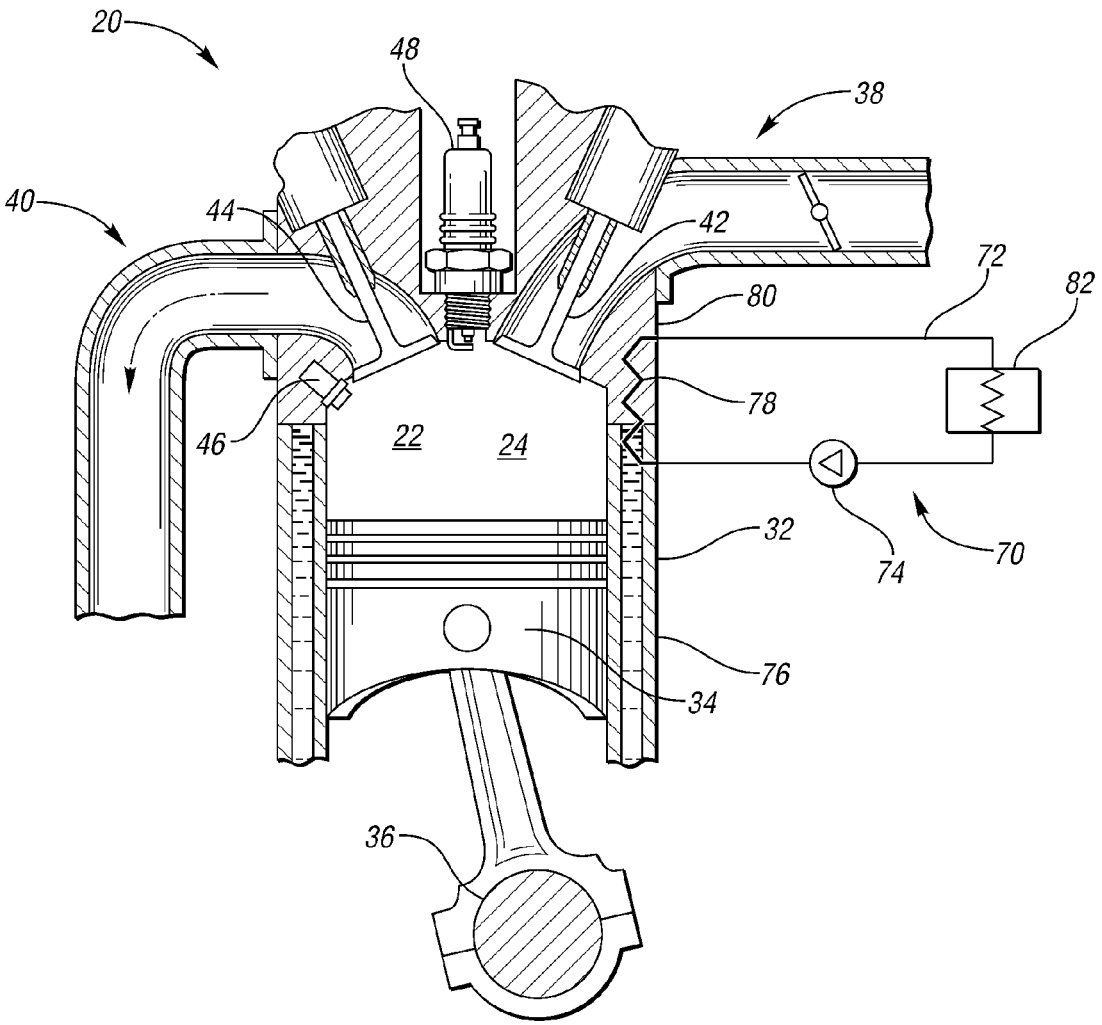
FIG. 1 illustrates a schematic of an engine configured to implement the disclosed embodiments.

FIG. 1 illustrates a schematic of an internal combustion engine 20. The engine 20 has a plurality of cylinders 22, and one cylinder is illustrated. In one example, the engine 20 is an in-line four cylinder engine, and, in other examples, has other arrangements and numbers of cylinders. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 30. An exhaust valve 44 controls flow from the combustion chamber 30 to the exhaust manifold 40. The intake and exhaust valves 42, 44 may be operated in various ways as is known in the art to control the engine operation.

A fuel injector 46 delivers fuel from a fuel system directly into the combustion chamber 30 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 30. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, and the like. Engine sensors may include, but are not limited to, an oxygen sensor in the exhaust manifold 40, an engine coolant temperature, an accelerator pedal position sensor, an engine manifold pressure (MAP sensor, an engine position sensor for crankshaft position, an air mass sensor in the intake manifold 38, a throttle position sensor, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is then introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust manifold 40 and to an aftertreatment system such as a catalytic converter.

The intake and exhaust valve 42, 44 positions and timing, as well as the fuel injection timing and ignition timing may be varied for the various engine strokes.

The engine 20 includes a cooling system 70 to remove heat from the engine 20. The cooling system 70 may be controlled by a cooling system controller or the engine controller. The cooling system 70 may be integrated into the engine 20 as a cooling jacket. The cooling system 70 has one or more cooling circuits 72 that may contain water or another coolant as the working fluid. The cooling system 70 has one or more pumps 74 that provide fluid in the circuit 72 to cooling passages in the cylinder block 76 and cylinder head 80. Coolant may flow from the cylinder block 76 to the cylinder head 80, or vice versa. The cooling system 70 may also include valves (not shown) to control to flow or pressure of coolant, or direct coolant within the system 70.

The cooling passages in the cylinder block 76 may be adjacent to one or more of the combustion chambers 24 and cylinders 22, and the bore bridges formed between the cylinders 22. Similarly, the cooling passages in the cylinder head 80 may be adjacent to one or more of the combustion chambers 24 and cylinders 22, and the bore bridges formed between the combustion chambers 24.

The cylinder head 80 is connected to the cylinder block 76 to form the cylinders 22 and combustion chambers 24. A head gasket 78 in interposed between the cylinder block 76 and the cylinder head 80 to seal the cylinders 22. The gasket 78 may also have a slot, apertures, or the like to fluidly connect the jackets 84, 86. Coolant flows from the cylinder head 80 and out of the engine 20 to a radiator 82 or other heat exchanger where heat is transferred from the coolant to the environment.

Figure 2:
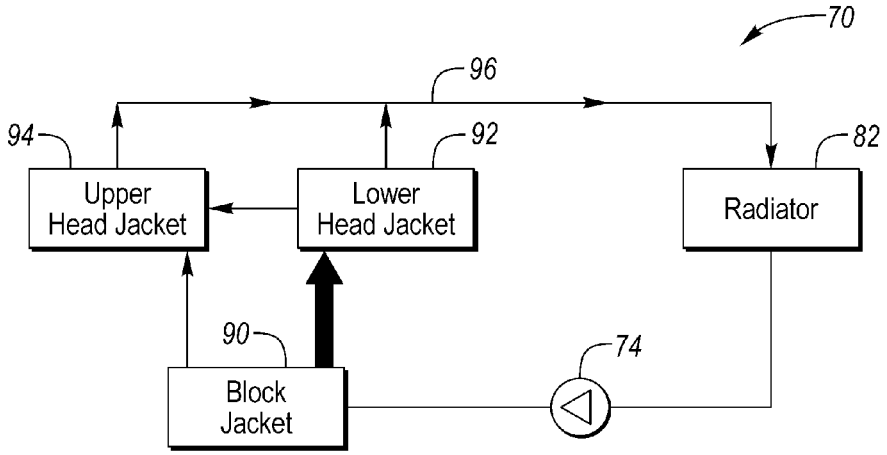
FIG. 2 illustrates a schematic of a cooling loop for the engine of FIG. 1 according to an embodiment.

FIG. 2 illustrates a cooling circuit 70 for use with the engine 20 of FIG. 1 according to an embodiment. The pump 74 provides pressurized coolant to a cooling jacket 90 in the cylinder block 76. The coolant then flow from the cooling jacket 90 to either a lower cooling jacket 92 in the cylinder head 80 or an upper cooling jacket 94 in the cylinder head 80. The majority of the coolant flows from the block jacket 90 to the lower head jacket 92.

Coolant within the lower head jacket 92 either flows to the upper head jacket 94 or flows through a return line 96 to the radiator 82. In one example, the lower head jacket 92 is connected to the upper head jacket 94 by a number of bridge pints between the jackets such as drills. Coolant within the upper head jacket 94 flows to the return line 96 and to the radiator 82.

In other examples, the block jacket, and upper and lower head jackets may be sequenced differently in the cooling circuit. The upper head jacket has a larger pressure difference with the block jacket compared to a pressure difference between the lower head jacket and the block jacket in the various embodiments of the disclosure.

The return line 96 may include additional components that are not shown, including, but not limited to: an oil cooler, transmission cooler, a cabin heat exchanger, and the like.

Figure 3:
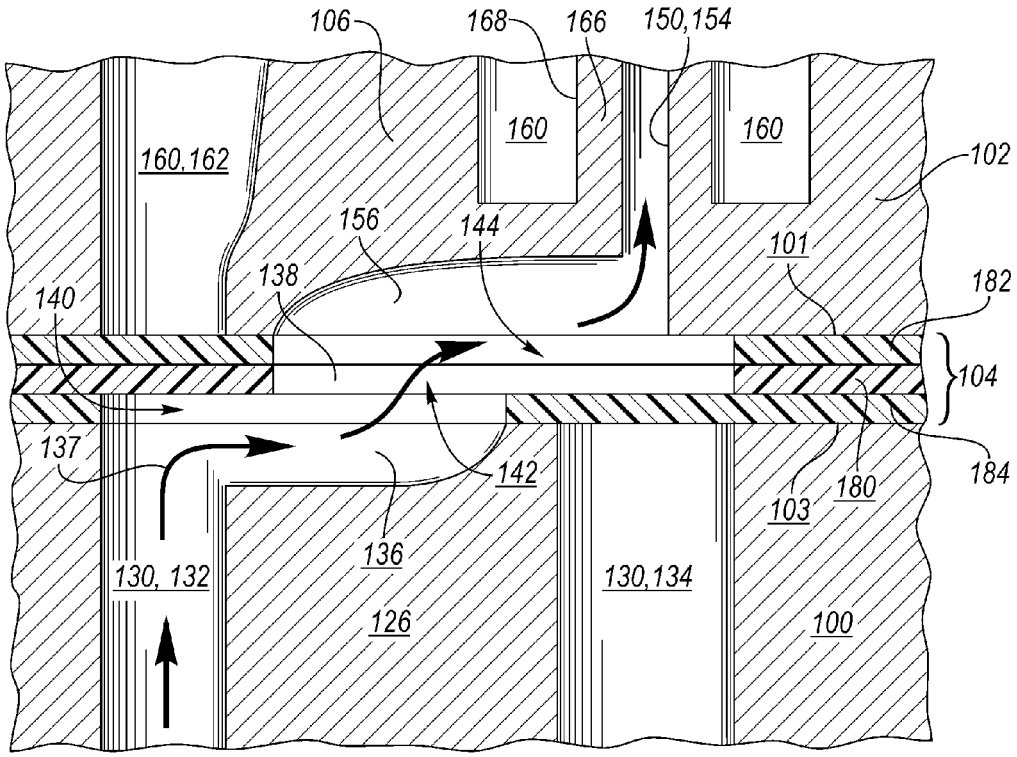
FIG. 3 illustrates a partial sectional view of an engine along the bore bridge according to an embodiment.
Figure 4:
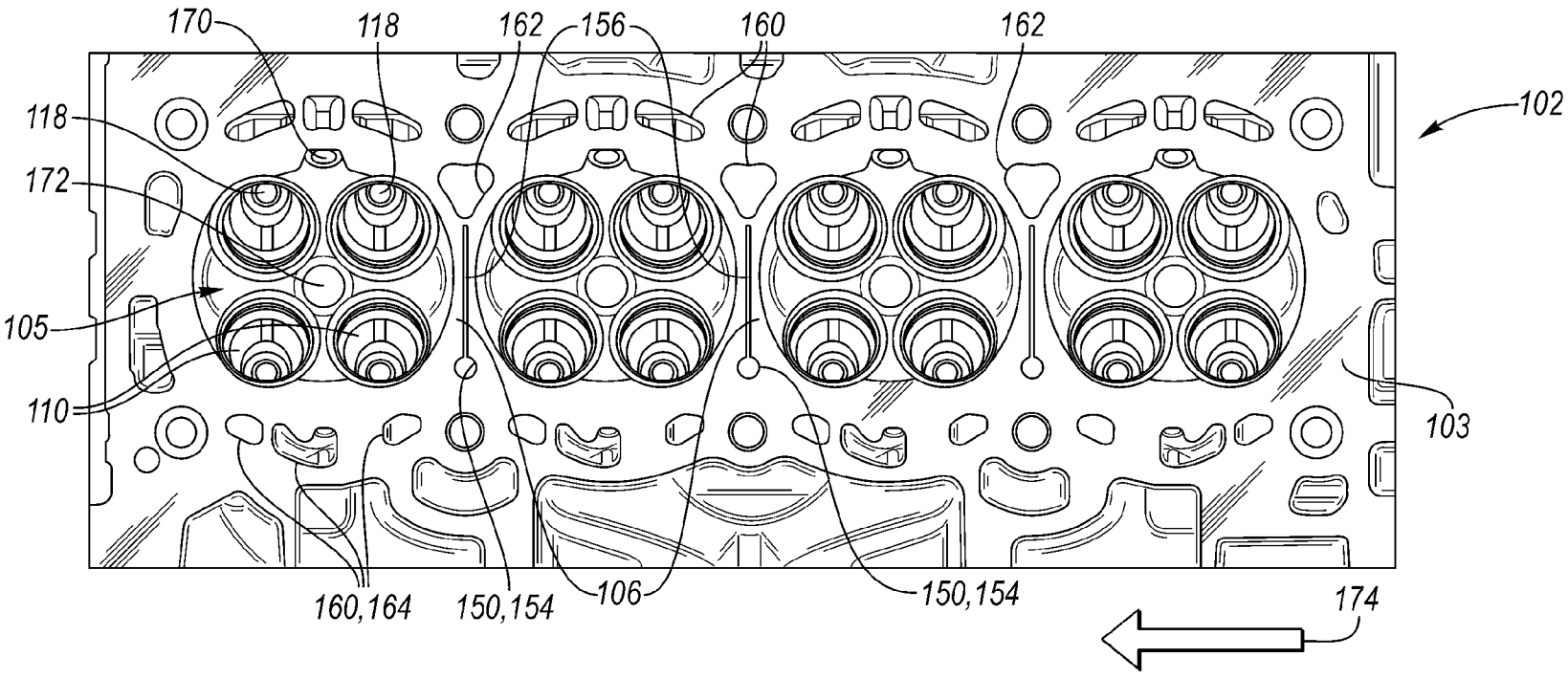
FIG. 4 illustrates a perspective view of a deck face of a cylinder head according to an embodiment.
Figure 5:
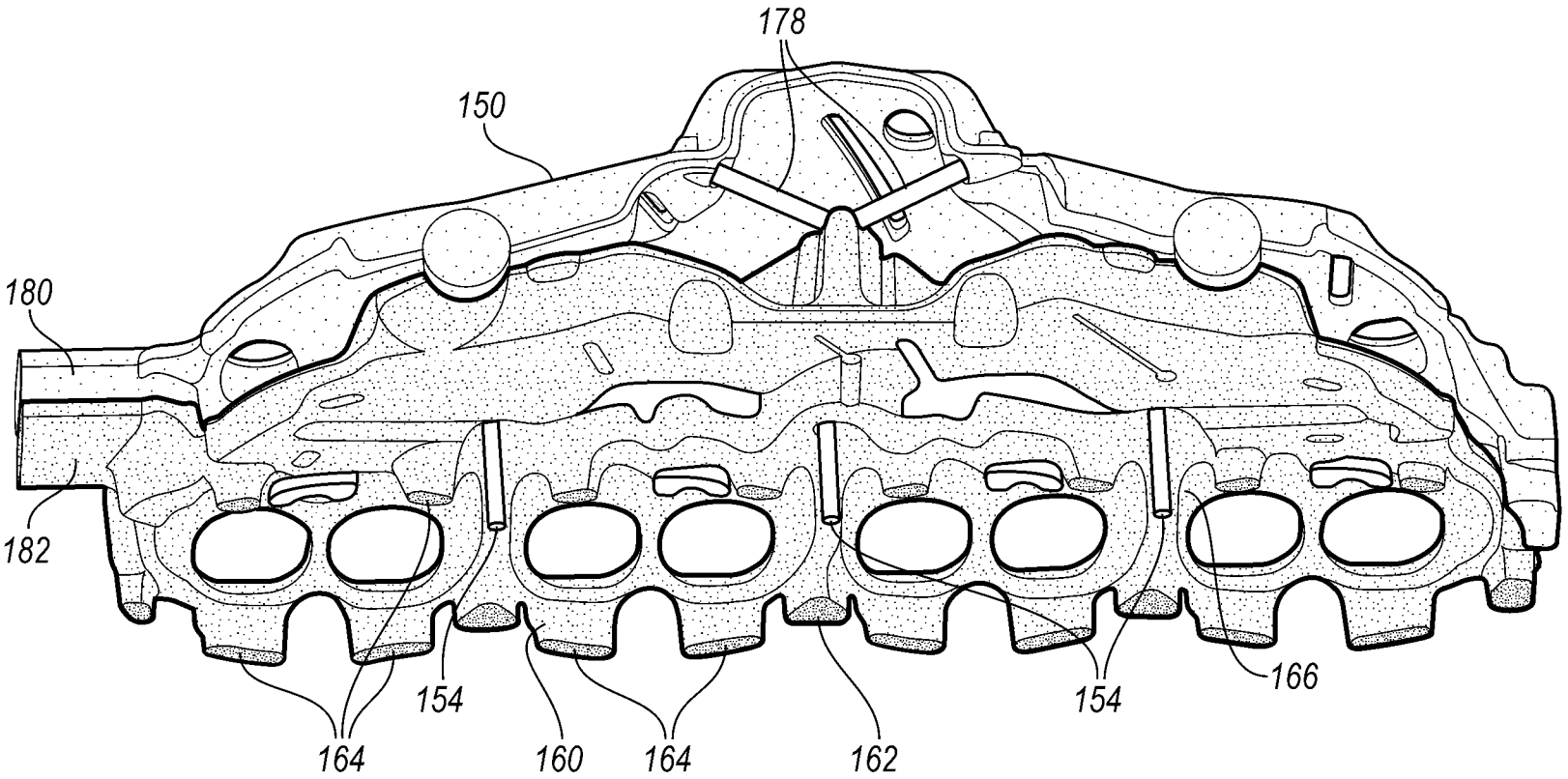
FIG. 5 illustrates casting cores for upper and lower cooling jackets of a cylinder head according to an embodiment.
Figure 6:
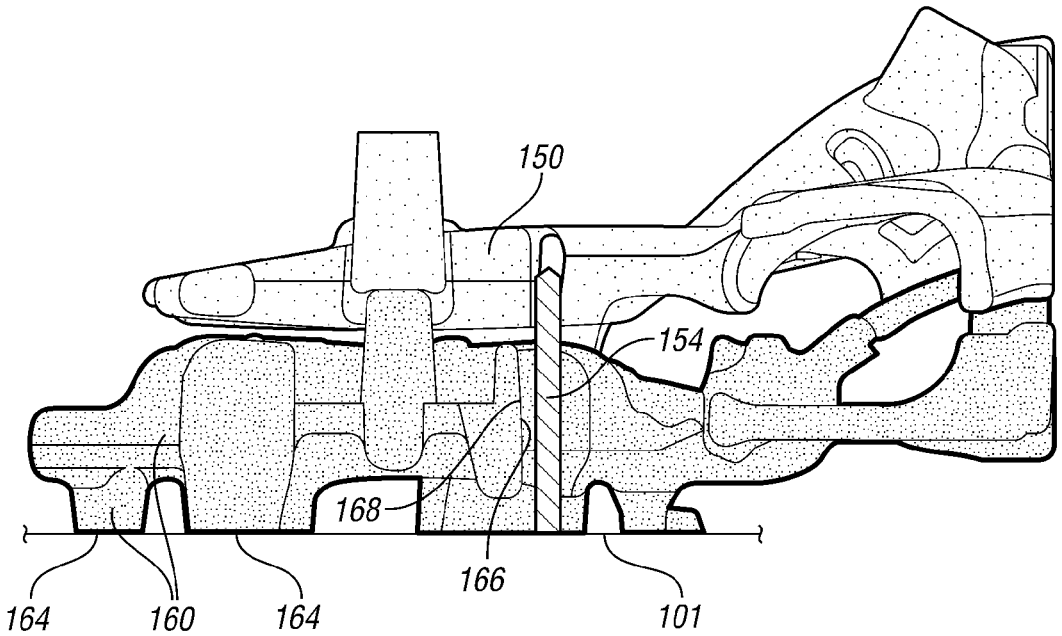
FIG. 6 illustrates a side cutaway view of the casting cores of FIG. 5.
Figure 7:
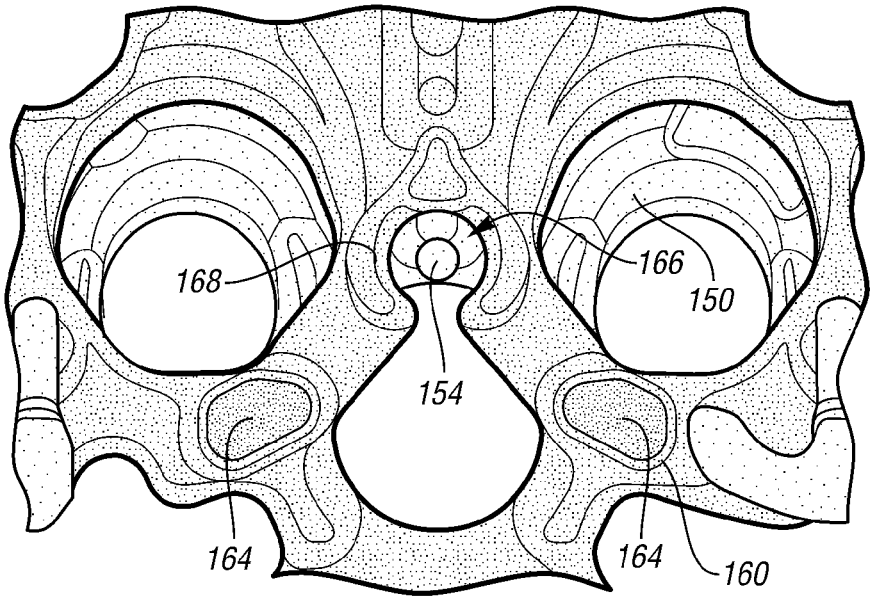
FIG. 7 illustrates a bottom view of the casting cores of FIG. 5 from the plane of a deck face.

FIGS. 3-7 illustrate an example of the present disclosure. FIG. 3 illustrates a schematic of fluid flow across a bore bridge according an example of the present disclosure. FIG. 4 illustrates the cylinder head. FIGS. 5-7 illustrate the upper and lower water jackets of the cylinder head.

The cooling system of FIG. 3 may be implemented on the engine illustrated in FIG. 1 and cooling circuit of FIG. 2. FIG. 3 illustrates cooling paths across both the cylinder head bore bridge and the cylinder block bore bridge, and in other embodiments, a cooling path may be present across only the cylinder head bore bridge or the cylinder block bore bridge based on the gasket design. The cylinder block 100 of the engine is connected to the cylinder head 102 using a head gasket 104 to form a combustion chamber in the engine. The deck face 101 of the cylinder block 100 and the deck face 103 of the cylinder head 102 are in contact with first and second opposed sides of the gasket 104.

Between adjacent chambers 105 in the cylinder head 102 are chamber bridges 106. The cylinder head 102 may have a pair of exhaust valves 108 in each chamber 105. The exhaust valves 108 are located in exhaust ports 110 in the cylinder head 102 and are seated on valve seats 112.

The cylinder head 102 has a pair of intake valves 116. The intake valves 116 are located in intake ports 118 in the cylinder head 102 and are seated on valve seats 120. The cylinder head 102 also has a spark plug 122.

Between adjacent cylinders 124 in the block 100 are bore bridges 126. The chambers 105 and the cylinders 124 cooperate to form combustion chambers for the engine. The gasket 104 may include a bead on each side of the gasket and surrounding the chambers 105 and cylinders 124 to help seal the combustion chambers of the engine.

Coolant in the block cooling jacket 130 flows from a passage 132 on the intake side, across bore bridge 126 and/or chamber bridge 106, and to a passage or drill 154 in the upper cooling jacket 150 on the exhaust side of the cylinder head 102. The passage 154 is at a lower pressure than passage 132. The bore bridge 126 may include a saw cut 136, or slot, in the deck face 101. The saw cut 136 may be connected to the passage 132 and spaced apart from an exhaust side passage 134 in the jacket 130. The saw cut 136 may be a machined groove. In other examples, the saw cut 136 may be omitted such that coolant flows along the deck face 101 to the passage 154. The gasket 104 may have one or more layers removed from the block side of the gasket 104 to provide a coolant flow path 137. The gasket 104 may form a slot 138 to fluidly connect passages 132, 154 and fluidly disconnect passages 134, 162 with the slot 138. Passage 162 forms part of the lower head cooling jacket 160. In other embodiments, the coolant may flow in the opposite direction, i.e. from the exhaust side to the intake side, or from the head to the block.

Coolant flows to the upper head cooling jacket 150 from the passage 132 on the intake side of the block 100, across the chamber bridge 106, and to a passage 154 in the upper cooling jacket 150 on the exhaust side of the cylinder head 102. The lower head jacket 160 may have a passage 162 on the intake side as well as other passages intersecting the head deck face 101. The passage 154 is at a lower pressure than passage 132, and also at a lower pressure than passage 162. The chamber bridge 106 may include a saw cut 156, or slot, in the deck face 103. The saw cut 156 may be spaced apart from the passage 162 and extend to and be connected to the passage 154. The gasket 104 may have one or more layers removed from the head side of the gasket 104 to provide the coolant flow path 137.

Coolant flow through the engine is generally shown by the arrows in FIG. 3. The gasket 104 may provide a coolant flow path 137 from the block 100 to the head 102 across one or both of the bridges 126, 106. The gasket 104 may provide a barrier at passages 134 or 162, thereby causing the coolant to flow transversely from an intake side to an exhaust side of the engine across the bore bridges and to the upper cooling jacket 150.

FIG. 4 illustrates a partial bottom perspective view of a cylinder head 102 employing an embodiment of the present disclosure. The cylinder head 102 may be cast out of a suitable material such as aluminum. The cylinder head 102 is a component in an in-line four cylinder engine, although other engine configurations may also be used with the present disclosure. The cylinder head 102 has a deck face 103 or bottom face that forms chambers 105. Each chamber 105 cooperates with a corresponding cylinder 124 in a cylinder block to form a combustion chamber. Each chamber 105 has a pair of intake ports 118 sized to receive intake valve seats and intake valves. Each chamber 105 also has a pair of exhaust ports 110 sized to receive exhaust valve seats and exhaust valves. A port 170 is provided for an injector, and another port 172 is provided for a spark plug. Various passages are also provided on the deck face 103 and within the cylinder head 102 that form an upper cooling jacket 150 and a lower cooling jacket 160 for the cylinder head and engine. The cooling jackets 150, 160 may cooperate with corresponding ports on the cylinder block to form a cooling jacket for the engine. Coolant in the cylinder head passages in the block deck face may travel along a longitudinal axis 174 or longitudinal direction of the engine such that coolant is provided to the cylinders in a sequential manner.

A chamber bridge 106 is formed between a pair of chambers 105. The chamber bridge 106 may require cooling with engine operation as the temperature of the bridge 106 may increase due to conduction heating from hot exhaust gases in the combustion chamber. The bridge 106 may be provided with a saw cut 156.

As can be seen in FIGS. 3 and 4, the upstream passage 132 may be a print such that it has a generally triangular shape or other appropriate shape where the passage intersects the respective deck face. The downstream passage 154 may be a drilled passage such that it has a generally circular shape where the passage intersects the respective deck face. In one example, the drilled passage 154 has a diameter of five millimeters. In other examples, the passage 154 diameter may be larger or smaller based on the arrangement of the cooling jackets in the head, etc.

FIGS. 5-7 illustrate the upper and lower cooling jackets 160, 150 for the cylinder head, and may represent the core used in casting the cooling jackets 150, 160 in the head 102. The lower jacket 160 is adjacent to the head deck face and is positioned substantially between the head deck face and the upper cooling jacket 150. The lower jacket 150 is operated at a higher pressure than the upper jacket 150. The passages 154 to the upper jacket 150 are shown extending down towards a deck face for use in cooling the bore bridge. Each passage 154 may be formed using a drill passage or the like, and may have a circular cross section or otherwise shaped cross section, and may have an effective diameter of five millimeters or less in one example. As shown in FIG. 6, the passage 154 may extend for approximately fifty millimeters from the upper jacket to the deck face in an example.

The lower cooling jacket 160 has passage 162 intersecting the deck face as well as other passages 164 intersecting the deck face and positioned to receive coolant from corresponding passages in the block cooling jacket to generally cool the engine.

The upper and lower jackets 150, 160 independently receive coolant from the block cooling jacket through the passages 154, and the passages 162, 164, respectively.

The passage 154 extends through a region 166 or window defined by and substantially surrounded by the lower cooling jacket 160 between the head deck face and the upper cooling jacket 150. The lower cooling jacket 160 may partially or substantially encircle the passage 154 of the upper jacket 150 in this region 166 as shown in FIG. 7. The lower jacket 160 is shaped to provide this window region 166 for the passage 154 to pass from the deck face to the upper cooling jacket 150. The lower jacket 160 may form a sleeve 168 that at least partially surrounds the passage 154 in the region 166. The sleeve 168 may be generally circular or cylindrical or otherwise shaped. In the example shown in FIG. 7, the sleeve 168 and the passage 154 are coaxial and concentric. The inner surface of the sleeve 168 of the lower jacket 160 may be spaced apart from the passage 154 by approximately the diameter of the passage 154. In some examples, the sleeve 168 partially surrounds the passage 154 as shown in FIG. 7. In a further example, the sleeve 168 substantially surrounds the passage 154, and may extend around 75% or more of the passage 154. In other examples, the sleeve 168 may entirely extend and surround the passage 154.

The upper cooling jacket 150 may also receive coolant from the lower jacket 160 through at least one crossover passage 178 or a bridge connection connecting the first and second head cooling jackets such that coolant flows from the lower head jacket 160 to the upper head jacket 150. Coolant exits the upper and lower jackets 160, 150 through return ports 180, 182 respectively to return line 96 of FIG. 2.

Various embodiments of the present disclosure have associated, non-limiting advantages. For example, in small packaged, high performance engines, the bore bridge, or region between adjacent cylinders may reach high temperatures during engine operation such that cooling the bore bridge is desirable. Because the engine packaging is small, there are few heat transfer paths for this region to be cooled. High temperatures at the bore bridge may lead to the cylinder block deforming, and the like. Also, at high temperatures, the head gasket may also deform or become overheated and lead to a reduced sealing capability for the combustion cylinders. The bore bridge may be cooled using coolant flowing through sawcuts in the bore bridges. The bore bridge cooling may be increased by providing coolant at high velocity in the bore bridge region, leading to increased convective heat transfer. The coolant velocity is increased by an increase in the pressure difference across this region, as coolant at high pressure will flow to a low pressure region. The pressure difference may be increased by increasing pressure on the feed side or lowering pressure on the exit side of the bore bridge region. The cylinder head of the engine has an upper cooling jacket and a lower cooling jacket, where the upper cooling jacket pressure is lower because there are few direct feeds of coolant to the upper jacket. By using the upper cooling jacket, a very low exit pressure may be provided, and a larger cooling pressure difference across the bore bridge region may be achieved, thereby providing a higher coolant velocity and greater heat transfer. Connecting to the upper head jacket from the block jacket may be challenging based on the geometry of the jackets, and the tight tolerances and engine packaging.

While exemplary embodiments are described above, it is not intended that these embodiments describe all possible forms of the present disclosure. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. An internal combustion engine comprising:

a cylinder block having a deck face defining first and second cylinders adjacent to one another, and a block cooling jacket; and a cylinder head having a deck face defining first and second chambers adjacent to one another, the cylinder head defining a first head cooling jacket and a second head cooling jacket configured to operate at a lower pressure than the first head cooling jacket, a majority of the first head cooling jacket positioned between the head deck face and the second head cooling jacket;

wherein the first chamber and the first cylinder form a first combustion chamber, and the second chamber and the second cylinder form a second combustion chamber, the first and second combustion chambers separated by a bore bridge;

wherein the block cooling jacket has an outlet passage intersecting the block deck face on a first side of the bore bridge;

wherein the second head cooling jacket has an inlet passage intersecting the head deck face on a second side of the bore bridge, the inlet passage of the second head jacket being surrounded within the cylinder head by a cooling passage of the first head jacket, the cooling passage of the first head jacket forming a sleeve around the inlet passage of the second head jacket such that the inlet passage of the second head jacket is encircled by the cooling passage of the first cooling jacket in a region of the cylinder head between the head deck face and the second cooling jacket; and wherein coolant flows from the outlet passage along at least one of the block deck face and head deck face and to the inlet passage to cool the bore bridge.

2. The engine of claim 1 wherein the block cooling jacket has a first series of passages intersecting the block deck face apart from the first side of the bore bridge;

wherein the first head cooling jacket has a second series of passages intersecting the block deck face apart from the second side of the bore bridge; and wherein coolant flows from the first series of passages to the second series of passages.

3. The engine of claim 1 wherein the cylinder head further defines at least one crossover passage connecting the first and second head cooling jackets such that coolant flows from the first head jacket to the second head jacket.

4. The engine of claim 1 further comprising a head gasket interposed between the cylinder block and the cylinder head, the gasket having a channel fluidly connecting the outlet and inlet passages along the bore bridge.

5. The engine of claim 1 wherein the block cooling jacket is configured to operate at a higher pressure than the first and second head cooling jackets.

6. The engine of claim 1 wherein the inlet passage of the second head is formed by a drill passage.

7. The engine of claim 6 wherein the drill passage has a diameter of less than five millimeters.

8. The engine of claim 7 wherein the drill passage has a length of at least fifty millimeters from the cylinder head deck face to the second head cooling jacket.

9. The engine of claim 1 wherein the block cooling jacket, first head cooling jacket, and second head cooling jacket form a cooling circuit for the engine, the second head jacket receiving coolant from the block cooling jacket and the first head jacket.

10. The engine of claim 9 wherein the first head jacket receives coolant from only the block cooling jacket.

11. The engine of claim 1 wherein coolant is provided from the block jacket to the second head jacket through the inlet passage.

12. A cylinder head for an engine comprising:

a body defining a deck face with first and second chambers adjacent to one another and separated by a bore bridge, the body defining a first cooling jacket and a second cooling jacket configured to operate at a lower pressure than the first cooling jacket, the first cooling jacket positioned substantially between the deck face and the second cooling jacket;

wherein the first cooling jacket has a series of passages intersecting the deck face and configured to receive coolant from a cylinder block cooling jacket; and wherein the second cooling jacket has an inlet passage intersecting the deck face adjacent to the bore bridge and configured to receive coolant from the cylinder block cooling jacket to cool the bore bridge;

wherein a section of the inlet passage to the second cooling jacket is surrounded by a sleeve passage formed by the first cooling jacket in a region of the cylinder head between the deck face and the lower cooling jacket such that the sleeve passage encircles the inlet passage in the region.

13. The cylinder head of claim 12 wherein the inlet passage to the second cooling jacket extends through a cylindrical section of the cylinder head defined by the first cooling jacket.

14. The cylinder head of claim 12 wherein the first cooling jacket provides coolant to the second cooling jacket at a bridge connection within the cylinder head.

15. The cylinder head of claim 12 wherein the inlet passage has a circular cross section.

16. An engine comprising:

a cylinder head defining an upper cooling jacket having a first passage intersecting a deck face adjacent a bore bridge, and a lower cooling jacket providing coolant to the upper jacket within the head and having a second passage intersecting the face to independently receive coolant from a cylinder block jacket and a sleeve passage positioned between the face and the upper jacket to coaxially and concentrically surround the first passage.

17. The engine of claim 16 wherein the sleeve passage coaxially and concentrically surrounds the first passage to extend seventy-five percent or more of the first passage.

* * * * *